US007353931B2

(12) United States Patent
Jarvis et al.

(10) Patent No.: US 7,353,931 B2
(45) Date of Patent: Apr. 8, 2008

(54) COMB PLATE FOR PASSENGER CONVEYOR WITH MOVING FLANGE

(75) Inventors: Dave Jarvis, Woodcliff, NJ (US); Frank Sansevero, Glastonbury, CT (US); Qingdong Richard Jiang, Guangzhou (CN); Yanying Anne Chen, Guangzhou (CN); Dietmar Thaler, Seggebrach (DE); Ruoming Roy Tian, Guangzhou (CN); Alexander Bellendir, Obernkirchen (DE)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 10/543,943

(22) PCT Filed: Feb. 7, 2003

(86) PCT No.: PCT/EP03/01252

§ 371 (c)(1),
(2), (4) Date: Nov. 3, 2006

(87) PCT Pub. No.: WO2004/069725

PCT Pub. Date: Aug. 19, 2004

(65) Prior Publication Data

US 2007/0144865 A1 Jun. 28, 2007

(51) Int. Cl.
*B66B 29/06* (2006.01)

(52) U.S. Cl. ..... 198/325; 198/324

(58) Field of Classification Search ..... 198/323, 198/324, 325, 338

See application file for complete search history.

(56) References Cited

U.S. PATENT DOCUMENTS

| | | | | |
|---|---|---|---|---|
| 3,233,717 | A * | 2/1966 | Minejiro et al. | 198/323 |
| 3,986,595 | A * | 10/1976 | Asano et al. | 198/333 |
| 4,519,490 | A * | 5/1985 | White | 198/333 |
| 4,800,998 | A * | 1/1989 | Myrick | 198/323 |
| 5,242,042 | A * | 9/1993 | Mauldin | 198/333 |
| 5,560,468 | A * | 10/1996 | Inoue | 198/333 |
| 5,695,040 | A * | 12/1997 | Watanabe et al. | 198/333 |
| 5,718,319 | A | 2/1998 | Gih | |
| 6,213,278 | B1 * | 4/2001 | Tanigawa | 198/333 |
| 6,398,002 | B1 * | 6/2002 | Choquette et al. | 198/325 |

(Continued)

FOREIGN PATENT DOCUMENTS

| | | |
|---|---|---|
| JP | 2002284474 A | 10/2002 |
| WO | WO 02/14201 A | 2/2002 |
| WO | WO 02/44071 | 6/2002 |

OTHER PUBLICATIONS

PCT International Search Report for PCT/EP03/01252, dated Sep. 15, 2003.

(Continued)

*Primary Examiner*—Douglas A Hess
(74) *Attorney, Agent, or Firm*—Carlson, Gaskey & Olds

(57) ABSTRACT

Comb plate (18) for a passenger conveyor (2) with a conveyor band and a moving flange a number of teeth (24) arranged on it essentially parallel to one another across the width of the conveyor band, which mesh in use with grooves (6) provided on the upper surface of the conveyor band characterised by a deflector guard (26) which is arranged at the lateral edge of the comb plate (18) and extends a certain height above the upper surface of the comb plate (18).

11 Claims, 3 Drawing Sheets

U.S. PATENT DOCUMENTS

Figure 1:
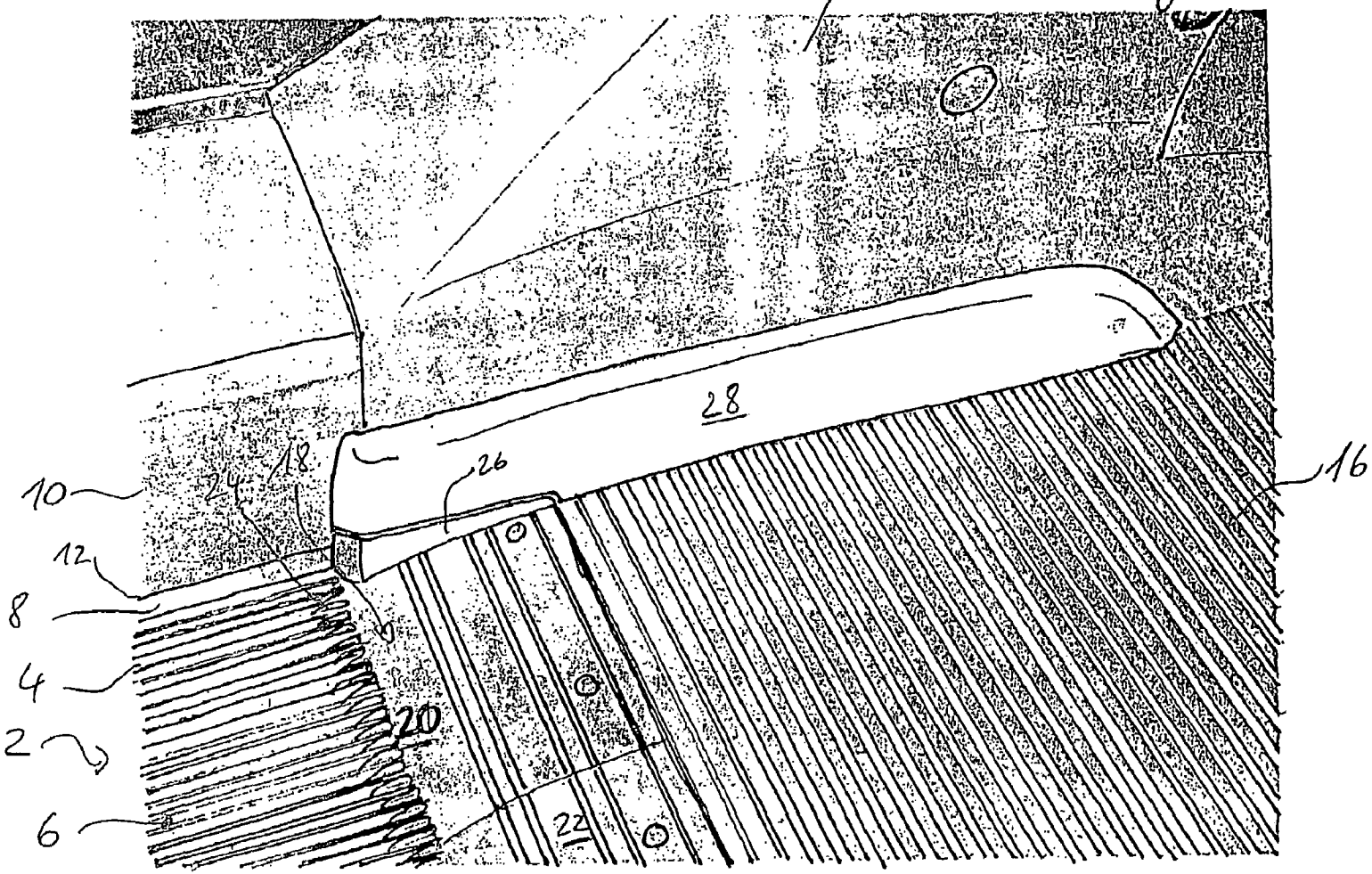

| | | | | |
|---|---|---|---|---|
| 6,450,316 | B1 | 9/2002 | Hauer et al. | |
| 6,644,457 | B2 * | 11/2003 | Lauch | 198/322 |
| 7,222,713 | B2 * | 5/2007 | Hauer et al. | 198/333 |
| 2002/0060126 | A1 * | 5/2002 | Behle et al. | |

OTHER PUBLICATIONS

PCT International Preliminary Examination Report for PCT/EP03/01252, dated Jan. 14, 2005.

* cited by examiner 16
14
28
26
18
24
22
20
10
12
8
4
2
6

COMB PLATE FOR PASSENGER CONVEYOR WITH MOVING FLANGE

The present invention relates to a comb plate for a passenger conveyor including an endless conveyor band and a moving flange, having a base plate and a number of teeth arranged on it essentially parallel to one another across the width of the conveyor band, which mesh in use with a cleating or grooves provided on the upper surface of the conveyor band. The present invention further relates to a passenger conveyor having such a comb plate.

A passenger conveyor of this type is known from WO 02/44071 A1, for example.

Comb plates prevent objects, such as clothing, shoes, or bags of passengers from being entrapped at the place where the conveyor belt "disappears" in operation. For this purpose, teeth or prongs are provided, which mesh with corresponding grooves in the step belt. The teeth are bevelled in such a way that move an object carried along with the step band away and thus prevent it from being caught or crushed.

The step band is the area of the passenger conveyor that conveys or moves the passengers. On it, along the exposed surface of the path of movement, the travelling guests are carried along, walking or standing. In an escalator, the conveyor band is called step band. This step band consists of several steps connected to one another by the drive chains which are located at each sides of the step band. In moving side walks, the conveyor band consists of several pallets which are connected to one another by the drive chains as well. Alternatively, with moving walks, the conveyor band may also be formed by an endless band of, for example, reinforced rubber material, or other suitable flexible material.

Comb plates consist for example of diecast tin or cast aluminium and have about 80 teeth in each case, about 2 mm wide and 40 mm long.

Moving flanges, which are also referred to as moving skirt or moving panel, increase security of the conveyor against entrapment due to the relative motion of the conveyor belt and the fixed skirt of conventional conveyors, which skirt is commonly provided laterally adjacent to the conveyor band. While this risk for entrapment has been dealt with by the introduction of the moving flanges, the risk for entrapment still existed at the entry of the steps and moving flange at the exit landing of the conveyor.

It is therefore the object of the present invention to even further improve the safety of passenger conveyors having a moving flange.

According to the present invention, this object is accomplished by a comb plate having a deflector guard which is arranged at the lateral edge of the comb plate and extends a certain height above the upper surface of the comb plate.

The lateral side of the deflector guard is positioned closely to the moving flange so as to deflect any objects or body parts which might come in this critical area next to the moving flange entry. The risk for entrapment of such objects is thus greatly reduced. Typically, the conveyor includes a fixed inner decking which extends over and covers the moving flange. Thus, there is only a portion of the moving flange exposed to the environment while a remaining portion thereof is covered by the inner decking. Preferably, the deflector guard is at least so high that it extends along the exposed portion of the moving flange. More preferred, however, the deflector guard extends also above over a portion of the inner decking. This ensures that the deflector guard exposes a larger surface area to any object facilitating deflection thereof.

Preferably, the deflector includes a nose which protrudes in use below the lower edge of the inner decking towards the moving flange. Such nose is suitable for further reducing the gap between the moving flange and the deflector guard. It is to be noted that there typically is also a gap between the inner decking and the deflector guard. As the deflector guard is attached to the comb plate, it has to be movable therewith. For security reasons, the comb plate is not immovably fixed to the conveyor truss but movable to some extend against a certain force. If for example the comb plate locks with a step, the step will move the comb plate relative to the truss until a security switch will shut off the conveyor and cut off power to the conveyor drive. In order to allow for such a movement, it is necessary that the comb plate and deflector guards can move a certain distance relative to the truss, the inner decking, etc.

Preferably, the deflector guard is integrally formed with the comb plate. This construction is particularly preferred as it allows for a simple and secure attachment thereof to the comb plate and further allows for a cost efficient implementation thereof. Alternatively, the deflector guard may be attached to the comb plate by means of fasteners such as screws or bolts and nuts. This allows for an adjustment thereof in the conveyor and further allows for attaching deflector guards to existing comb plates.

Preferably, the deflector guard tapers laterally outwards in the direction of the comb teeth and towards the free ends thereof. This taper deflects or guides any object away from the moving flange. By providing this nose, it is possible to have essentially the same gap width between the deflector guard and the so moving flange and the deflector guard and the inner decking, respectively. As the inner decking is no moving part, the gap distance between the inner decking and the deflector guard may also be smaller than that between moving flange and deflector guard.

Preferably, a cover is positioned above the deflector guard. While the deflector guard is preferably of the same material as the comb plate, such cover can be of a different material, for example a plastic material, which is cheeper to manufacture. Moreover, as the comb plate is typically fabricated by way of an die cast process, excessively high flanges at the lateral edges thereof complicate such manufacturing process. Moreover, excessively high flanges at the edges thereof are prone for braking, etc. The cover can be attached to the truss, i.e. the inner decking and/or the handrail entry box, which is typically connecting to the inner decking with a slight gap being preferably provided between the deflector guard and the cover, This gap allows for a certain movement of the comb plate and deflector guard in case of an emergency situation as referred to above.

It has to be noted that deflector guards can be provided at each lateral edges of the comb plate. Moreover, such deflector guards can be provided at the entry and exit landings as well as with the upper and lower landings with escalators.

Figure 2:
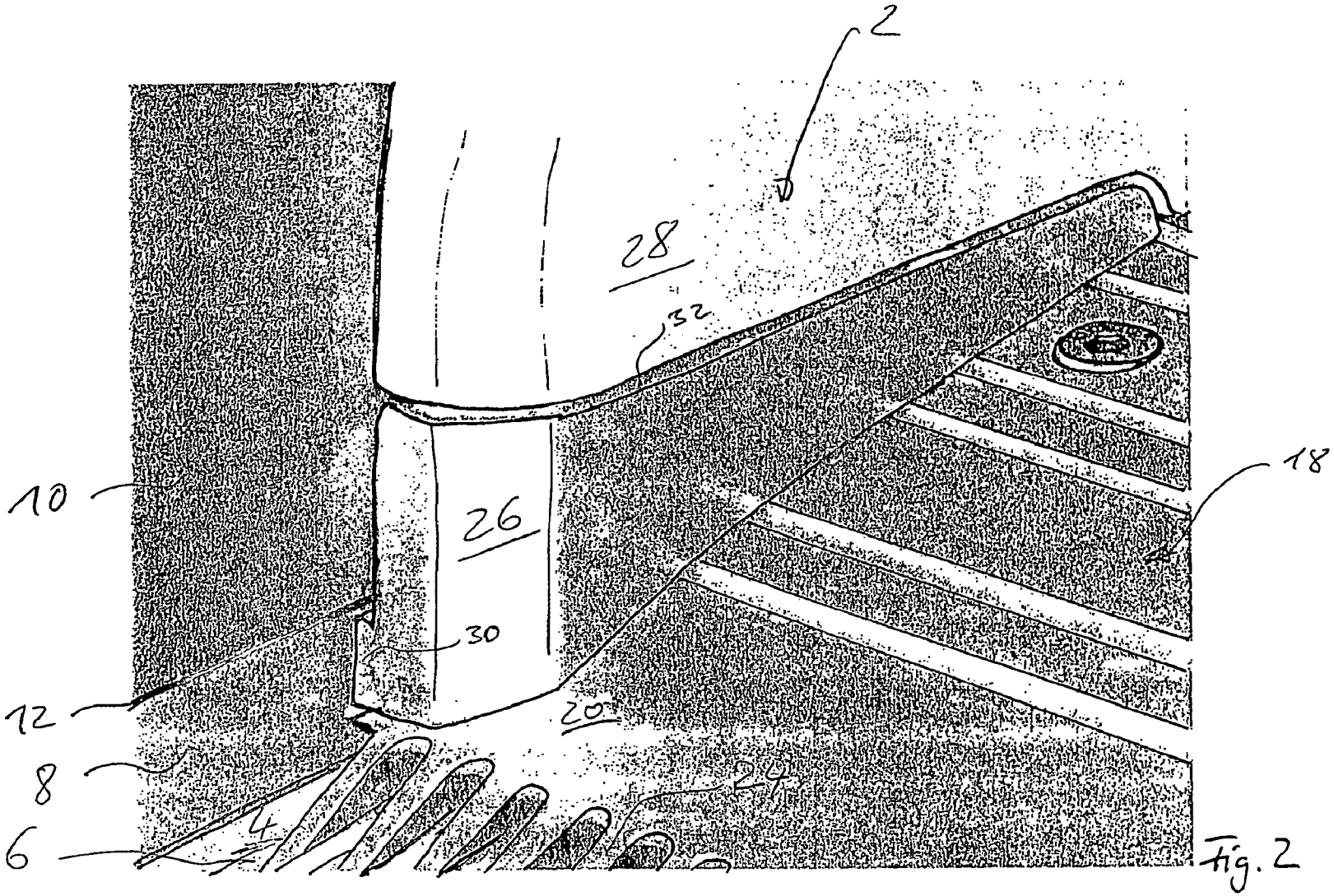
Figure 3:
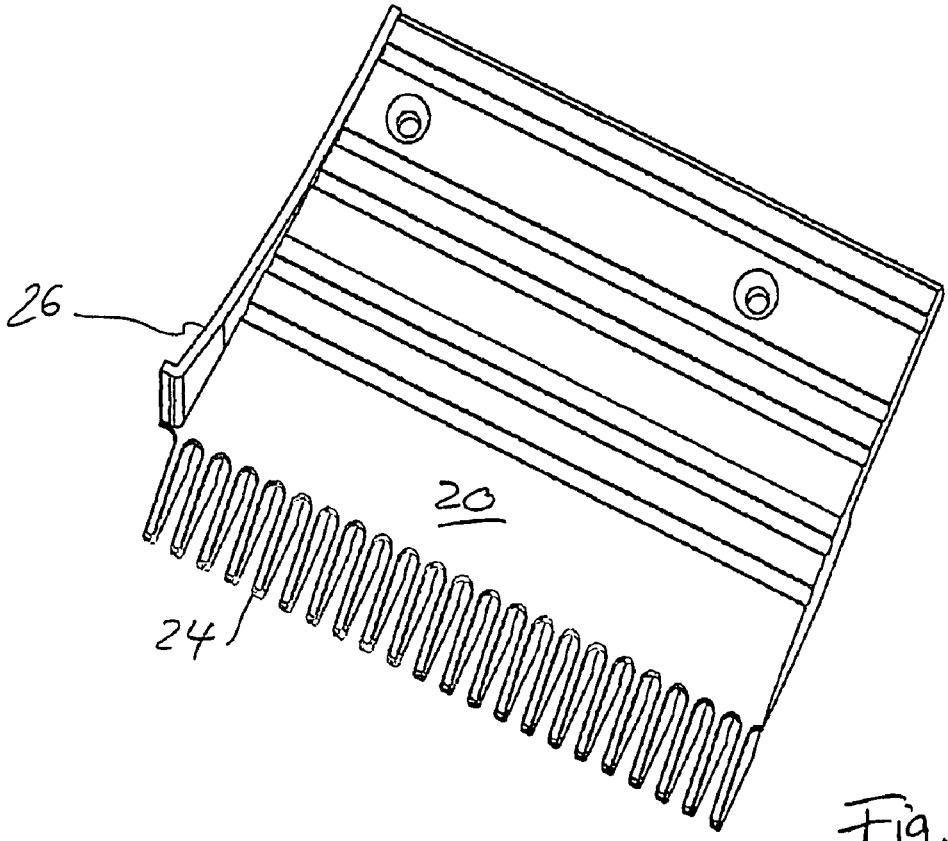

The invention and embodiments of the invention are described in greater detail below with reference to the figures, wherein FIG. 1 shows a portion of the conveyor belt entry area of a conveyor according to the present invention in perspective view;

FIG. 2 a detail of the conveyor of FIG. 1 in perspective view;

FIG. 3 a comb plate segment according to the present invention; and

Figure 4:
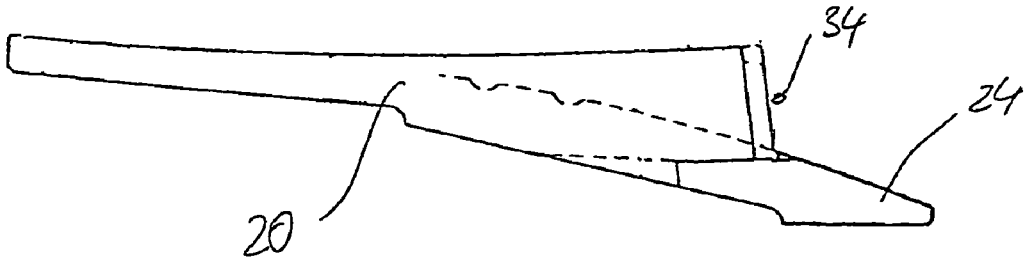

FIG. 4 a side view of the inventive comb plate.

In FIG. 1 part of a conveyor 2 is shown. Particularly FIG. 1 shows an upper landing of a conveyor. A step 4 having a plurality of grooves 6 on its upper surface is representative for a step band or conveyor band. The conveyor band has a moving flange 8 on each of its lateral edges. An inner decking 10 extends with its lower edge 12 over the moving flange. The inner decking 10 and the moving flange 8 avoid any entrapment of objects at the lateral edges of the conveyor band.

The inner decking 10 is fixed to a support structure (not shown) for example the escalator truss. It generally consists of a sheet metal material or any other material of sufficient strength. Connected to the inner decking 10 is a handrail entry box 14 which provides the lateral limitation of the entry area 16. A comb plate 18 including a plurality of comb plate segments 20, 22 is provided in the usual way at the entry area of the step band. The comb plate segments 20, 22 each comprises a plurality of teeth 24 co-operating with the grooves 6 on the step belt.

A deflector guard 26 is provided at each lateral edge of the comb plate 18 for deflecting any objects away from the moving flange 8 in the entry area thereof.

A cover 28 covering the deflector guard 26 is attached to the handrail entry box 14 and covers the upper portion of the deflector guard 26. While the deflector guard 26 is preferably made of the same material as the comb plate segments 20, 22 for different reasons, like stability, etc., the cover 28 can be made of a more cost effective material like plastics, etc.

In FIG. 2, the grooves 6 and teeth 24 are shown more clearly. FIG. 2 further shows the entry area of the moving flange 8 in more detail. Particularly, one can easily seen a nose 30 which reduces the gap between the deflector guard 26 and the moving flange 8. Theoretically, the gap between those parts, i.e. the moving flange 8 and the deflector guard 26, is as small as possible. Practically, however, a gap which is smaller than 4 mm, preferably in the range of 1 to 3 mm and most preferred around 2 mm can be maintain. Such gap is sufficient for avoiding entrapment of objects there between. It is to be noted that essentially a gap of the same width is also provided between the inner decking 10 and the deflector guard 26. Such gap is required in order to allow for a movement of the comb plate 18 and the deflector guard 26 in case of an emergency. A similar gap 32 is provided between the deflector guard 26 and the cover 28. This gap has to be wide enough to allow for a secure triggering of an emergency switch in case of an emergency by upward movement of the comb plate 18.

FIG. 3 shows the comb plate segment 20 and particularly shows the deflector guard 26 which is integrally provided thereon. The deflector guard 26 has a relatively thin wall thickness allowing for easy casting and reduced weight. In the side view of FIG. 4 one can see that the forward edge 34 of the deflector guard 26 is leaned or angled backwards to some degree. A substantially vertical orientation of the forward edge 34 is also preferred.

The invention claimed is:

1. Comb plate for a passenger conveyor with a conveyor band and a moving flange, the comb plate comprising:

a main body;

a plurality of teeth arranged essentially parallel to one another across a width of the main body and adapted to mesh with grooves provided on an upper surface of the conveyor band;

a deflector guard that is integrally formed with the main body, the deflector guard having substantially a length of the main body and arranged at a lateral edge of the main body and extending a certain height above an upper surface of the main body.

2. Comb plate according to claim 1, wherein the deflector guard comprises a nose protruding laterally outside in a direction that is substantially perpendicular to a direction of the plurality of teeth.

3. Comb plate according to claim 1, wherein the main body includes a plurality of comb plate segments.

4. Comb plate for a passenger conveyor with a conveyor band and a moving flange, the comb plate comprising:

a main body;

a plurality of teeth arranged essentially parallel to one another across a width of the main body and adapted to mesh with grooves provided on an upper surface of the conveyor band;

a deflector guard having substantially a length of the main body and arranged at a lateral edge of the main body and extending a certain height above an upper surface of the main body wherein the deflector guard is attached to the main body by fasteners.

5. Comb plate for a passenger conveyor with a conveyor band and a moving flange, the comb plate comprising:

a main body;

a plurality of teeth arranged essentially parallel to one another across a width of the main body and adapted to mesh with grooves provided on an upper surface of the conveyor band;

a deflector guard having substantially a length of the main body and arranged at a lateral edge of the main body and extending a certain height above an upper surface of the main body wherein the deflector guard tapers laterally outside in a direction of the plurality of teeth and towards a free end thereof.

6. Passenger conveyor comprising:

an endless conveyor band and a moving flange adapted to move together;

a comb plate having a main body;

a plurality of teeth arranged essentially parallel to one another across a width of the main body and adapted to mesh with grooves provided on an upper surface of the conveyor band;

a deflector guard that is integrally formed with the main body, the deflector guard having substantially a length of the main body and arranged at a lateral edge of the main body and extending a certain height above an upper surface of the main body.

7. Passenger conveyor according to claim 6, further comprising an inner decking extending over the moving flange, wherein the deflector guard extends above and below the lower edge of the inner decking and includes a nose that protrudes below the lower edge of the inner decking towards the moving flange.

8. Passenger conveyor according to claim 6, further comprising a cover positioned above the deflector guard.

9. Passenger conveyor according to claim 8, further comprising a gap located between the deflector guard and the cover.

10. Passenger conveyor according to claim 8, further comprising a handrail entry box laterally adjacent to the main body with the cover being attached to the handrail entry box.

11. Passenger conveyor according to claim 6, wherein the main body includes a plurality of comb plate segments.

* * * * *